US007251979B2

(12) United States Patent
Sakuragi et al.

(10) Patent No.: US 7,251,979 B2
(45) Date of Patent: Aug. 7, 2007

(54) METHOD OF PRODUCING FORGED PART AND METHOD OF PRODUCING SUSPENSION ARM FOR AUTOMOTIVE VEHICLES

(75) Inventors: Hideyori Sakuragi, Kanagawa (JP); Yoshihiro Konno, Tokyo (JP); Hidenobu Kawai, Shizuoka (JP)

(73) Assignees: Nissan Motor Co., Ltd., Yokohama-shi (JP); Nippon Light Metal Company, Ltd., Tokyo (JP)

( * ) Notice: Subject to any disclaimer, the term of this patent is extended or adjusted under 35 U.S.C. 154(b) by 80 days.

(21) Appl. No.: 11/176,684

(22) Filed: Jul. 8, 2005

(65) Prior Publication Data

US 2006/0005596 A1 Jan. 12, 2006

(30) Foreign Application Priority Data

Jul. 9, 2004 (JP) ..... 2004-203246

(51) Int. Cl.
*B21J 5/08* (2006.01)

(52) U.S. Cl. ..... 72/340; 72/377

(58) Field of Classification Search ..... 72/340, 72/377, 318, 356

See application file for complete search history.

(56) References Cited

U.S. PATENT DOCUMENTS 633,886 A * 9/1899 McTighe ..... 72/377
1,862,281 A * 6/1932 Schaefer ..... 72/377
4,710,245 A * 12/1987 Roether ..... 148/521
5,060,331 A * 10/1991 Shie ..... 470/23
5,115,663 A * 5/1992 Ando et al. ..... 72/369

FOREIGN PATENT DOCUMENTS

DE 33 45 280 A1 * 6/1985
JP 59-88210 * 5/1984
JP 08-039183 A 2/1996

* cited by examiner

*Primary Examiner*—Daniel C. Crane
(74) *Attorney, Agent, or Firm*—Foley & Lardner LLP

(57) ABSTRACT

A method of producing a forged part includes holding a material by a jig, upsetting the material, held by the jig, to a predetermined length by a pair of upsetting dies disposed on both ends of the material, while pressing the upsetting dies on the material, so as to produce large-diameter portions at the respective axial ends of the material. Next, a bending operation and a forging operation are made to the upset material, in that order. When forging, a direction, in which the material is forged, is set, so that a burr generated on the material by upsetting is included in a burr generated on the material by forging. Next, a finish-machining operation is made to the forged material to remove the burr left on the outer periphery of the material after forging. Thereafter, the finish-machined material is drilled to form bush-mounting holes in the large-diameter portions.

17 Claims, 4 Drawing Sheets

UPSETTING PROCESS
BENDING PROCESS
FORGING PROCESS
FINISHING PROCESS
DRILLING PROCESS
L
L1
2
4
6a
6b
8
10
12
22

METHOD OF PRODUCING FORGED PART AND METHOD OF PRODUCING SUSPENSION ARM FOR AUTOMOTIVE VEHICLES

TECHNICAL FIELD

The present invention relates to a method of producing a forged part and a method of producing a suspension arm for automotive vehicles.

BACKGROUND ART

In recent years, there have been proposed and developed various methods of producing a forged part such as a suspension arm for automotive vehicles. One such producing method of a forged part such as an automotive suspension arm has been disclosed in Japanese Patent Provisional Publication No. 08-39183 (hereinafter is referred to as "JP8-39183"). JP8-39183 relates to a manufacturing method including a roll-forming a bar-shaped member to predetermined length and thickness, a compression-forming the roll-formed member, a bending and rough-molding process of rough-molding the compression-formed member while bending the same, a finish-molding process of closed-die-forging (simply, close-forging) the rough-molded member to finish-mold the same, and a drilling process of drilling the finish-molded member. In the manufacturing method disclosed in JP8-39183, the member formed into a substantially final shape of a product by bending and rough-forming is worked by close-forging, so that no burr is generated and products can be enhanced in yield.

SUMMARY OF THE INVENTION

According to the manufacturing method disclosed in JP8-39183, however, a bar-shaped member is worked to predetermined length and thickness in the roll-forming process, so that a long processing time is required and that a manufacturing time per product becomes long. Thus, there is a problem of reduced production efficiency.

Accordingly, it is an object of the invention to provide a method of manufacturing a forged part, which method can efficiently finish a product while achieving a reduced manufacturing time.

It is another object of the invention to provide a method of manufacturing a suspension arm for an automotive vehicle, which method can efficiently finish a product while achieving a reduced manufacturing time.

In order to accomplish the aforementioned and other objects of the present invention, a method of producing a forged part, comprises holding a material by a jig, upsetting the material, held by the jig, to a first predetermined shape by a pair of upsetting dies disposed on both ends of the material, while pressing the upsetting dies on the material, forging the upset material into a second predetermined shape by a forging die assembly after upsetting, and finish-machining the forged material to remove a burr generated on an outer periphery of the material after forging, wherein, when forging, a direction, in which the material is forged, is set, so that a burr generated on the outer periphery of the material by the upsetting operation is included in a burr generated on the outer periphery of the material by the forging operation.

According to another aspect of the invention, a method of producing an automotive suspension arm, comprises holding a bar-shaped material by a clamp jig, upsetting the material, held by the clamp jig, to a first predetermined shape by a pair of upsetting dies disposed on both axial ends of the material, while pressing the upsetting dies on the material, so as to produce large-diameter portions at the respective axial ends of the material, bending the upset material by a bending die assembly, forging the bent material into a second predetermined shape by a forging die assembly after bending, finish-machining the forged material to remove a burr generated on an outer periphery of the material after forging, and drilling bush-mounting holes in the large-diameter portions of the axial ends of the finish-machined material, wherein, when forging, a direction, in which the material is forged, is set, so that a burr generated on the outer periphery of the material by the upsetting operation is included in a burr generated on the outer periphery of the material by the forging operation.

The other objects and features of this invention will become understood from the following description with reference to the accompanying drawings.

DESCRIPTION OF THE PREFERRED EMBODIMENTS

Figures 1A, 1B, 1C, 1D, 1E, 1F:
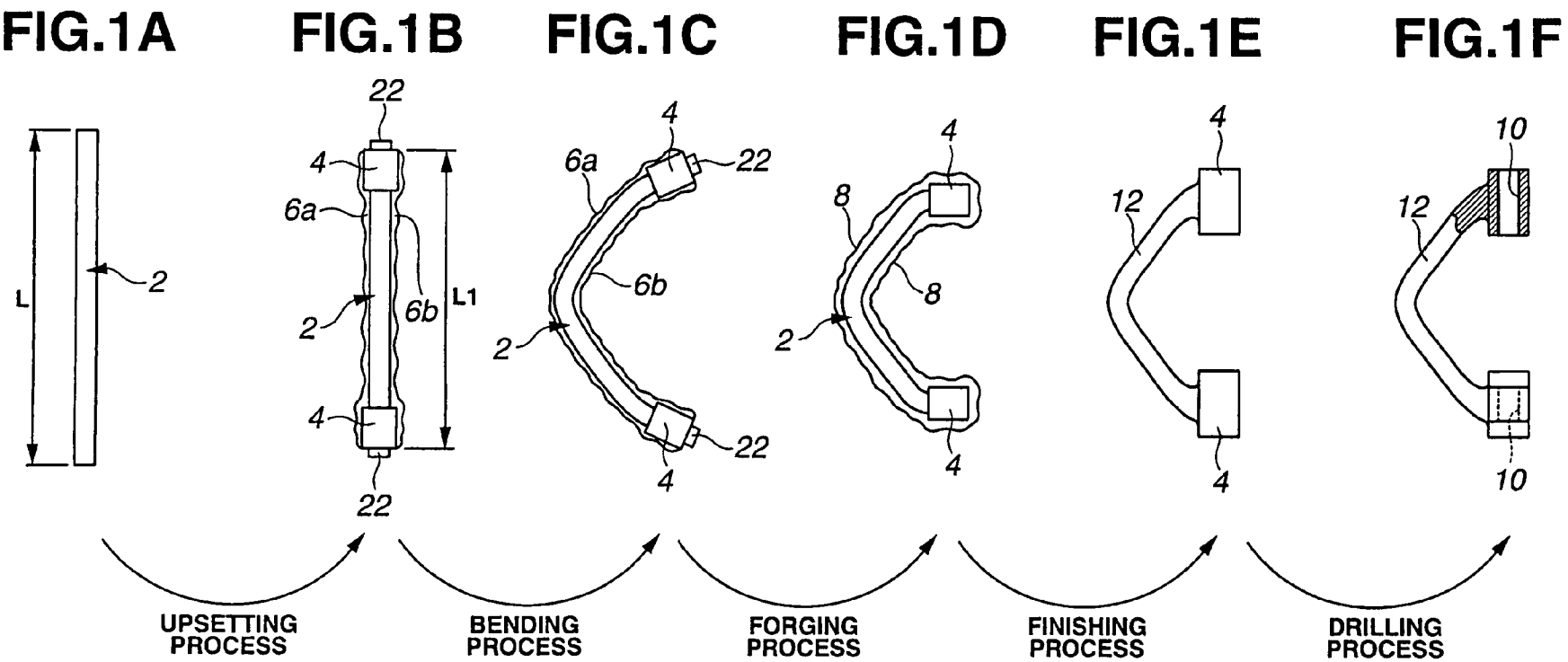
FIGS. 1A-1F are explanatory views illustrating a series of automotive suspension-arm producing processes of an embodiment, an upsetting process, a bending process, a forging process, a finish-machining process, and a drilling process.

Referring now to the drawings, particularly to FIGS. 1A-1F, there are shown the explanatory views illustrating a series of automotive suspension-arm manufacturing processes of the embodiment, that is, an upsetting process, a bending process, a forging process, a finish-machining process (simply, a finishing process), and a drilling process.

FIG. 1A shows a raw material 2 in the form of a round bar initially set to a predetermined length (an initial length) L. FIG. 1B shows the raw material 2 compressed or pressed by upsetting to have a predetermined length L1 (L1<L) and formed at both axial ends thereof with large-diameter portions 4, 4. Here, a pair of longitudinally-extending burred portions formed on the outer periphery of raw material 2 and continuously extending in the longitudinal direction of raw material 2 and denoted by reference numerals 6*a*, 6*b* are whisker-shaped burrs generated by the upsetting process. FIG. 1C shows the raw material 2 after being bent by bending from a state shown in FIG. 1B. FIG. 1D shows the raw material 2 after being subjected to forging from a state shown in FIG. 1C. Here, a pair of longitudinally-extending burred portions formed on the outer periphery of raw material 2 and continuously extending in the longitudinal direction of raw material 2 and denoted by reference numerals 8, 8 are burrs generated by the forging process. FIG. 1E shows the raw material 2 finish-formed or finish-machined (simply, finished) by finish-machining from a state shown in FIG. 1D and thus removing the burrs 8, 8 out of the outer periphery of raw material 2. FIG. 1F shows a product (a suspension arm) 12 after holes (bush-mounting holes) 10, 10, into which bushes are press-fitted, are formed in the large-diameter portions 4, 4 by drilling from a state shown in FIG. 1E.

Figure 2:
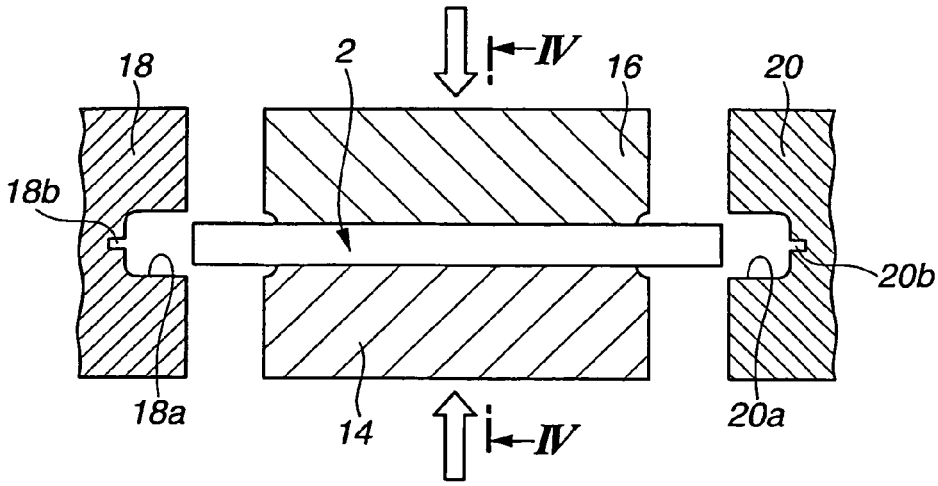
FIG. 2 is a cross-sectional view showing structures of a pair of clamp jigs holding a raw material and a pair of upsetting metal dies used in the suspension arm producing method of the embodiment.
Figure 3:
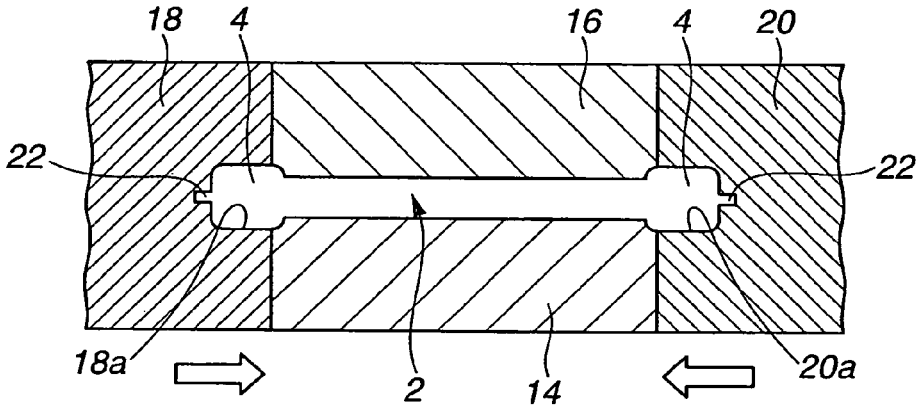
FIG. 3 is an explanatory view showing the upsetting process of the producing method of the embodiment.
Figure 4:
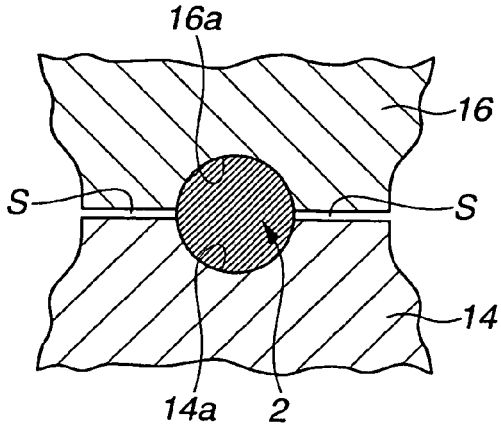
FIG. 4 is a cross-sectional view taken along the lines IV-IV shown in FIG. 2.
Figure 5:
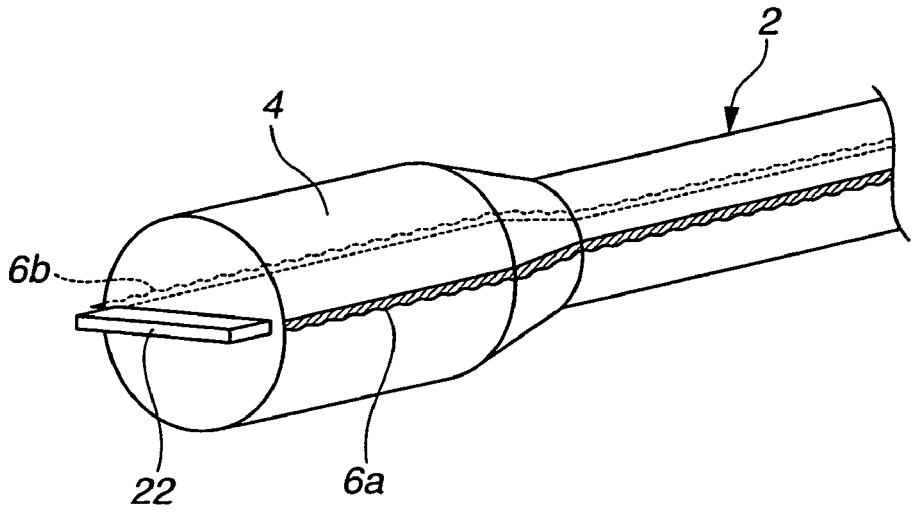
FIG. 5 is a perspective view illustrating whisker-shaped burrs generated on the outer periphery of the raw material after the upsetting process and a pair of burred-portion indicating marks formed on both end faces of the raw material.

FIGS. 2 to 4 schematically show an upsetting device that performs the upsetting process made to raw material 2.

As shown in FIG. 2, the outer periphery of the round-bar shaped raw material 2 is interposed or sandwiched or clamped or held between a lower clamp jig 14 and an upper clamp jig 16. As shown in FIG. 4, lower and upper clamp jigs 14 and 16 are formed with clamp curved surfaces 14*a*, 16*a*, which abut against the outer periphery (upper and lower halves) of raw material 2, and radii of curvature of the clamp curved surfaces 14*a*, 16*a* are set to a smaller value than a radius of the raw material 2. In order to prevent each of lower and upper clamp jigs 14 and 16 from galling on the mating surface of raw material 2, a clearance S having a predetermined dimension is provided between lower and upper clamp jigs 14 and 16 under a condition where raw material 2 is interposed or sandwiched therebetween.

Also, as shown in FIG. 2, an upsetting metal mold (simply, an upsetting die) 18 and an upsetting metal mold (simply, an upsetting die) 20, respectively, are arranged or disposed on one longitudinal end face and the other longitudinal end face of raw material 2 interposed between lower and upper clamp jigs 14 and 16.

A first upsetting die 18 of the above-mentioned upsetting dies 18 and 20 is comprised of a die portion 18*a* needed to form the large-diameter portion, which is formed to be concave and larger than an outer peripheral shape of raw material 2, and a recessed die portion 18*b* for marking, in the form of a concave groove formed on the inner wall of the die portion 18*a* for the large-diameter portion, against which one end face of raw material 2 abuts. Also, the second upsetting die 20 is comprised of a die portion 20*a* for the large-diameter portion, which has the same shape as that of the die portion 18*a* for the large-diameter portion, and a concave-groove shaped or recessed die portion 20*b* for marking, formed on the inner wall of the die portion 20*a* for the large-diameter portion, against which the other end face of raw material 2 abuts. Each die portion (18*a*, 20*a*) for the large-diameter portion is referred to as an "upsetting die portion", while each die portion (18*b*, 20*b*) for marking is referred to as a "marking die portion".

When the upsetting process is performed by moving the first and second upsetting dies 18 and 20 in the opposite axial directions of round-bar shaped raw material 2, in which they approach each other, as shown in FIG. 3 and compressing raw material 2 axially inwards, the raw material 2 having predetermined length L1 (shorter than initial length L) is resulted or produced. Raw material 2 are formed at its both ends with large-diameter portions 4, 4 by way of upsetting die portions 18*a*, 20*a* and in which convex marks or substantially diametrically-extending elongated, protruded marker portions 22, 22 are formed on the respective end faces of the large-diameter portions 4, 4 of the round-bar shaped raw-material ends by way of marking die portions 18*b* and 20*b*.

Here, since the aforementioned clearance S is provided between lower and upper clamp jigs 14 and 16, which interpose or sandwich therebetween the raw material 2, whisker-shaped burrs 6*a* and 6*b* in two diametrically-opposed positions, which are linear symmetrical with respect to an axis of raw material 2, are generated on the outer periphery of raw material 2, for which the upsetting process has been completed, such that whisker-shaped burrs 6*a* and 6*b* extend longitudinally continuously in the axial directions of raw material 2 (see FIG. 1B). Convex marks (marker portions) 22, 22 simultaneously formed on both end faces of raw material 2 by the upsetting process are formed in a band-like manner to extend in a direction along a diameter connecting positions, in which the whisker-shaped burrs 6*a* and 6*b* have been generated or formed. Convex marks 22, 22 formed on both end faces of material 2 by the upsetting operation serve as upset portions needed to recognize or indicate the positions of the burrs generated or left on the outer periphery of material 2 by the upsetting operation.

Figure 6:
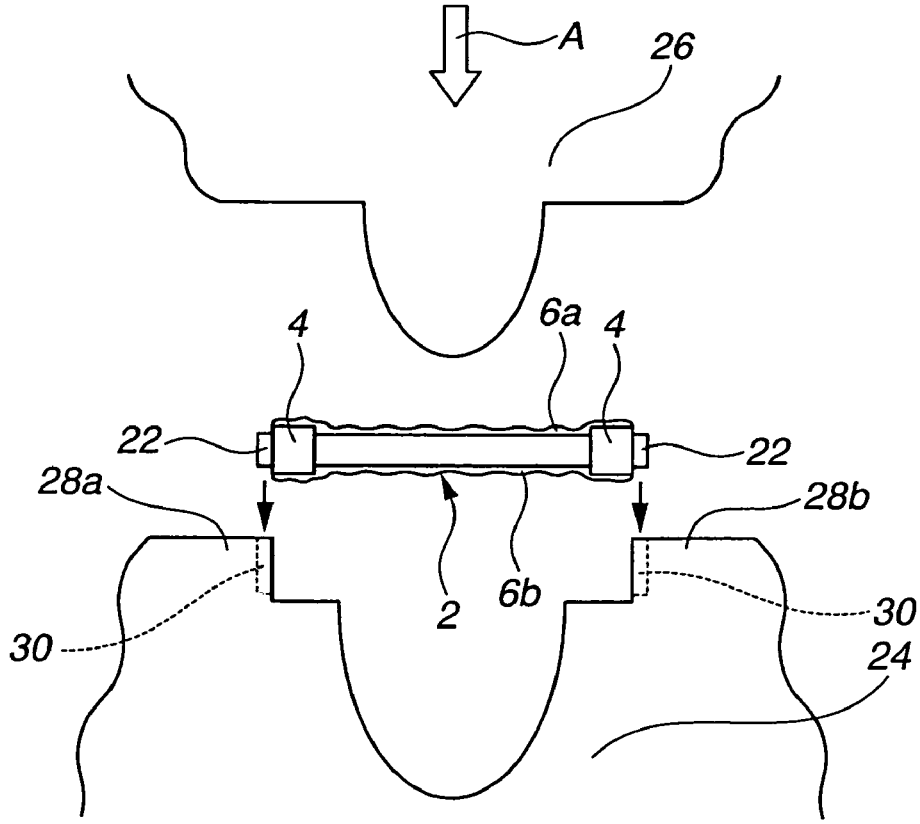
FIG. 6 is a view showing a bending device that performs the bending process constructing one of the automotive suspension arm producing processes of the embodiment.

Referring now to FIG. 6, there is shown the bending device that performs the bending process to the raw material 2, for which the upsetting process has been completed. The bending device includes a female metal die 24, a male metal die 26, and raw-material setting portions 28*a*, 28*b* that arrange raw material 2 between female metal die 24 and male metal die 26 to set or determine a direction, in which raw material 2 is subjected to bending and forging. Female metal die 24 and male metal die 26 construct a bending die assembly.

Female metal die 24 is fixed to a stand (not shown), while male metal die 26 is arranged to be movable toward female metal die 24.

Also formed on an end face of one of the raw-material setting portions is a first positioning groove 30, into which the convex mark 22 formed on one of the end faces of raw material 2 is fitted. The first positioning groove 30 extends straight along a direction (hereinbelow, abbreviated "A direction"), in which male metal die 26 is moved. Also formed on the other raw-material setting portion to extend straight along the A direction is the second positioning groove 30, into which the convex mark 22 formed on the other end face of raw material 2 is fitted.

Then, the raw material 2 set between female metal die 24 and male metal die 26 with the convex marks 22, 22 fitted into the respective positioning grooves 30, 30 formed in the raw-material setting portions is set in a direction of bending shown in FIG. 6. More specifically, since the convex marks 22, 22 extend along the A direction, the direction of bending is set so that the whisker-shaped burrs 6*a*, 6*b* generated on the outer periphery also extend along the A direction.

Figure 7:
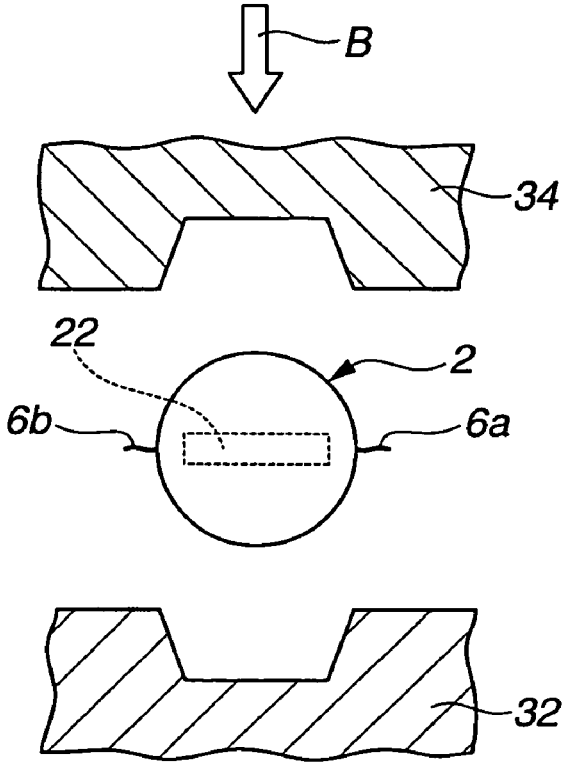
FIG. 7 is a view showing a forging device that performs the forging process constructing one of the automotive suspension arm producing processes of the embodiment.
Figure 8:
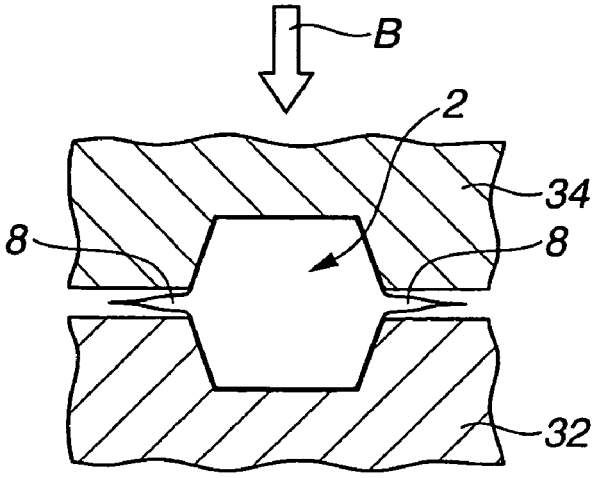
FIG. 8 is a view showing positions of burrs left on the raw material after the forging process.

FIGS. 7 and 8 schematically show the process of forging being performed on the raw material 2, for which bending has been completed.

As shown in FIG. 7, the forging device that performs the forging process includes a first female metal die (simply, a first forging die) 32 and a second female metal die (simply, a second forging die) 34. The first forging die 32 is fixed to a stand (not shown), while the second forging die 34 is arranged to be movable toward the first forging die 32. The first and second forging dies 32 and 34 constructs a forging die assembly.

Raw material 2, which is subjected to forging, is set or put on the first forging die 32 to be made substantially U-shaped as viewed from above. Thus since the convex marks 22, 22 extend in a direction perpendicular to a direction (hereinbelow, abbreviated "B direction"), in which the second forging die 34 is moved, a direction of forging is set or determined so that the whisker-shaped burrs 6*a* and 6*b* generated or left on the outer periphery of raw material 2 also extend in a direction perpendicular to the B direction.

When the raw material 2 set in a direction of forging is subjected to forging by means of the first and second forging dies 32 and 34, burrs 8, 8 (see FIG. 1D) being comparatively large in size are generated or left in the same positions as those positions (in a direction perpendicular to the B direction), in which the whisker-shaped burrs 6*a* and 6*b* are generated.

The burrs 8 and 8 of raw material 2, generated in the same positions as whisker-shaped burrs 6*a* and 6*b*, are removed by finish-machining (see FIG. 1E).

As will be appreciated from the above, the automotive suspension-arm manufacturing method of the embodiment contributes to the reduced processing time or reduced machining time, since a raw material having a predetermined length L1 and provided at both ends thereof with large-diameter portions 4 is formed in compression forming by way of an upsetting process.

In the manufacturing method of the embodiment, burrs 8, 8 are generated when forging the raw material, but the burrs 8, 8 are generated in the same positions as whisker-shaped burrs 6*a*, 6*b*, generated in the upsetting process. In this manner, the burrs 6*a*, 6*b* generated in the upsetting process are included in the respective burrs 8, 8 generated in the forging process, so that it is unnecessary to remove the burrs 6*a*, 6*b* before shifting to forging, thus ensuring the reduced working hour.

Besides, by simply fitting the convex marks (protruded or ridged portions) 22, 22, which are formed on both end faces of raw material 2 by way of the upsetting process, into the positioning grooves (positioning recessed portions) 30, 30 of the raw-material setting portions, a direction of bending of raw material 2 can be easily set so that the burrs 8, 8 generated on the raw material 2 when forging are generated in the same positions as whisker-shaped burrs 6*a*, 6*b* generated in the upsetting process. That is, the convex marks (protruded or ridged portions) 22, 22, provided as members for positioning of raw material 2, ensures simple setting of the raw material 2 for the bending process.

Accordingly, according to the forged-part manufacturing method of the embodiment, it is possible to efficiently produce or manufacture a suspension arm for automobiles, while achieving a reduction in manufacturing time or reduced production costs.

Additionally, according to the producing method of the embodiment, for marking purposes, the first and second upsetting dies 18 and 20 are formed with the respective concave-shaped marking die portions 18*b* and 20*b* extending in the bending direction of material 2, and the bending direction of material 2 is set or determined by fitting the convex marks (protruded or ridged portions) 22, 22 to respective positioning groves 30, 30 of material setting portions 28*a*, 28*b*. In lieu thereof, for positioning purposes, concave marks (recessed or trough portions) may be formed on both end faces of material 2 by way of the upsetting process, and additionally positioning projections (positioning protruded portions) may be formed in the respective material setting portions of a female metal die (a fixed metal die) 24. Concretely, each of the first and second upsetting dies 18, 20 is formed to have an elliptical-shaped cross section in a direction perpendicular to an axis of a material, such that the material is formed at the time of upsetting to have an elliptical-shaped cross section at both ends thereof. A direction of bending of the material may be set by fitting the ends of the round-bar shaped material, each having the elliptical-shaped cross section, into the positioning projections of the fixed metal die.

The entire contents of Japanese Patent

Application No. 2004-203246 (filed Jul. 9, 2004) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A method of producing a forged part, comprising:

holding an outer periphery of a material between split jigs;

upsetting the material, held by the jigs, to a first predetermined shape with a pair of upsetting dies disposed on both ends of the material by pressing the upsetting dies on the material, wherein a burr is formed on the outer periphery of the material in a clearance (S) defined between the jigs during the upsetting operation;

forging the upset material into a second predetermined shape with split forging dies after upsetting, wherein a burr is formed on the outer periphery of the material during the forging operation; and finish-machining the forged material to remove the burr generated on the outer periphery of the material after forging, wherein, when forging, a direction in which the material is forged is set to a forging direction such that a position of the burr formed during the forging operation is the same as a position of the burr formed during the upsetting operation.

2. The method as claimed in claim 1, wherein:

the upsetting operation further comprises forming a mark on the material to indicate the position of the burr formed on the outer periphery of the material by the upsetting operation, the mark being used for setting the forging direction such that the position of the burr formed during the forging operation is identical to the position of the burr formed during the upsetting operation.

3. The method as claimed in claim 2, wherein:

each of the upsetting dies comprises an upsetting die portion for the upsetting operation and a marking die portion formed on an abutted surface of at least one of the upsetting dies, wherein the upsetting dies are brought into abutted-engagement with both end faces of the material during the upsetting operation, wherein the marking die portion forms the mark on an end face of the material.

4. The method as claimed in claim 3, wherein:

the marking die portion comprises a recessed die portion that forms a protruded marker portion on the end face of the material.

5. The method as claimed in claim 1, wherein the burr formed during the upsetting operation extends parallel to an axis of the part, wherein the burr formed during the forging operation extends parallel to the same axis of the part as the burr formed during the upsetting operation.

6. The method as claimed in claim 1, wherein the burr formed during the upsetting operation extends along a longitudinal axis of the part.

7. The method as claimed in claim 1, wherein the burr formed during the upsetting operation and the burr formed on the outer periphery of the material during the forging operation are oriented substantially similarly to one another.

8. A method of producing an automotive suspension arm, comprising:

holding an outer periphery of a bar-shaped material between split clamp jigs;

upsetting the material, held by the clamp jigs, to a first predetermined shape with a pair of upsetting dies disposed on both axial ends of the material by pressing the upsetting dies on the material and forming a burr on the outer periphery of the material in a clearance (S) defined between the clamp jigs during the upsetting operation, wherein the upsetting operation produces large-diameter portions at respective axial ends of the material;

bending the upset material with a bending die assembly;

forging the bent material into a second predetermined shape with split forging dies after bending, wherein a burr is formed on the outer periphery of the material during the forging operation;

finish-machining the forged material to remove the burr generated on the outer periphery of the material after forging; and drilling bush-mounting holes in the large-diameter portions of the axial ends of the finish-machined material, wherein, when forging, a direction in which the material is forged is set to a forging direction such that a position of the burr formed during the forging operation is the same as a position of the burr formed during the upsetting operation.

9. The method as claimed in claim 8, wherein:

the upsetting operation further comprises forming a mark on the material to indicate the position of the burr formed on the outer periphery of the material by the upsetting operation, the mark being used for setting the forging direction such that the position of the burr formed during the forging operation is the same as the position of the burr formed during the upsetting operation.

10. The method as claimed in claim 9, wherein:

each of the upsetting dies comprises an upsetting die portion for the upsetting operation and a marking die portion formed on an abutted surface of at least one of the upsetting dies, wherein the upsetting dies are brought into abutted-engagement with both axial end faces of the material during the upsetting operation, wherein the marking die portion forms the mark on an axial end face of the material.

11. The method as claimed in claim 10, wherein:

the marking die portion comprises a recessed die portion that forms a protruded marker portion on the axial end face of the material.

12. The method as claimed in claim 8, wherein the burr formed during the upsetting operation extends parallel to an axis of the part, wherein the burr formed during the forging operation extends parallel to the same axis of the part as the burr formed during the upsetting operation.

13. The method as claimed in claim 8, wherein the burr formed during the upsetting operation extends along a longitudinal axis of the part.

14. A method of producing a forged automotive part, comprising:

upsetting a material with upsetting dies, wherein the material is held between split jigs during the upsetting operation, wherein a burr is formed on an outer periphery of the material in a clearance formed between the jigs during the upsetting operation, forging the upset material with split forging dies after the upsetting operation, wherein a burr is formed on the outer periphery of the material during the forging operation, and removing the burr formed during the upsetting and forging operations, wherein the forging operation is performed so that the burr formed during the forging operation is formed in the same position as the burr formed during the upsetting operation.

15. The method as claimed in claim 14, wherein the burr formed during the upsetting operation extends parallel to an axis of the part, wherein the burr formed during the forging operation extends parallel to the same axis of the part as the burr formed during the upsetting operation.

16. The method as claimed in claim 14, wherein the burr formed during the upsetting operation extends along a longitudinal axis of the part.

17. The method as claimed in claim 14, wherein the burr formed during the upsetting operation and the burr formed on the outer periphery of the material during the forging operation are oriented substantially similarly to one another.

* * * * *